US008992277B2

(12) United States Patent
Macias

(10) Patent No.: US 8,992,277 B2
(45) Date of Patent: Mar. 31, 2015

(54) STAND UP PADDLE INCLUDING A VARIETY OF ATTACHMENTS

(71) Applicant: Carlos Macias, Fort Lauderdale, FL (US)

(72) Inventor: Carlos Macias, Fort Lauderdale, FL (US)

( * ) Notice: Subject to any disclaimer, the term of this patent is extended or adjusted under 35 U.S.C. 154(b) by 51 days.

(21) Appl. No.: 13/678,963

(22) Filed: Nov. 16, 2012

(65) Prior Publication Data

US 2013/0122761 A1 May 16, 2013

Related U.S. Application Data

(60) Provisional application No. 61/560,346, filed on Nov. 16, 2011.

(51) Int. Cl.

| | |
|---|---|
| ***B63H 16/04*** | (2006.01) |
| ***B63B 35/79*** | (2006.01) |
| ***A63B 59/02*** | (2006.01) |
| ***A63B 67/00*** | (2006.01) |
| *B63B 21/54* | (2006.01) |
| *E02B 15/00* | (2006.01) |

(52) U.S. Cl.

CPC ..... *B63B 35/7933* (2013.01); *B63H 16/04* (2013.01); *A63B 59/02* (2013.01); *B63B 21/54* (2013.01); *E02B 15/00* (2013.01); *A63B 67/007* (2013.01); *A63B 2210/50* (2013.01)

USPC ..... 441/74; 440/101

(58) Field of Classification Search

CPC B63B 35/7906; B63B 35/79; B63B 35/7933; B63B 35/73; B63B 35/7913; B63H 16/04

USPC ..... 441/66, 74; 440/101, 102, 104; 114/147

See application file for complete search history.

(56) References Cited

U.S. PATENT DOCUMENTS

| | | | | |
|---|---|---|---|---|
| 1,817,414 | A * | 8/1931 | Korth | 403/42 |
| 4,031,650 | A * | 6/1977 | Popeil | 43/12 |
| 5,062,816 | A * | 11/1991 | Berglund et al. | 440/101 |
| 5,157,854 | A * | 10/1992 | Rumsey, Jr. | 43/12 |
| 5,815,977 | A * | 10/1998 | Hill, Jr. | 43/25 |
| 6,659,822 | B1 * | 12/2003 | Dombeck | 441/35 |
| 7,942,106 | B2 * | 5/2011 | Cromartie | 114/221 R |
| 2004/0064996 | A1 * | 4/2004 | Armenti | 43/7 |
| 2011/0217889 | A1 * | 9/2011 | Tom | 440/104 |

* cited by examiner

*Primary Examiner* — Lars A Olson
*Assistant Examiner* — Anthony Wiest
(74) *Attorney, Agent, or Firm* — Robert M. Schwartz

(57) ABSTRACT

A stand up paddle surfboard (SUPS) and associated paddle is provided. The SUPS may have up to two containers affixed generally towards the bow. A first container is designed to retain refuse and a second container is designed to retain game ball(s). The paddle includes a removable handle on a first side of a shaft and a paddle with a securable net and hook on the second side of the shaft. The securable net and hook may be employed to remove refuse found in the water and place such in the first container. The removable handle may be replaced with a game net permitting a host of ball toss games and the like to be played, using the second container to retain such balls. The SUPS and associated paddle may be modified for watersports as well as environmental cleanup activities.

10 Claims, 10 Drawing Sheets

SECTION A-A OF FIG.3

STAND UP PADDLE INCLUDING A VARIETY OF ATTACHMENTS

RELATED APPLICATIONS

This utility application claims priority from U.S. Provisional Patent Application Ser. No. 61/560,346 filed on Nov. 16, 2011 and entitled Standup Paddleboard Sweeper.

BACKGROUND OF THE INVENTION

According to Wikipedia on the world wide web, stand up paddle surfing (SUP), is an emerging global sport with a Hawaiian heritage. The sport is an ancient form of surfing, and has recently reemerged as a popular sport in its own.

One reason for the rise in popularity of stand up paddle boarding is that, unlike surfing, paddle boarding is very easy to learn. It is not unreasonable that within one hour a person can become very comfortable in the water and on your board.

A stand up paddle is a type of paddle used in stand up paddle surfing. The stand up paddle is used to propel an individual across the surface of the water while standing on a surf board stand up paddle board. The paddle consists of a blade, a shaft and a handle.

Paddles used for stand up surfing are usually constructed from carbon, fiberglass or wood with flat blade on one end connecting to a handle on the other end by a long smooth shaft. The blade ranges from 6 to 10 inches in width with an oval or round shaft ranging from 67 to 86 inches in length with a 1 to 1.5 inch diameter. Blades are designed with several shapes and features. Normally the blade has a pizza stone shape sometimes having a slight keel on the back side of the blade. Other commonly used shapes include diamonds, or oar like blades, and other geometrical configurations.

BRIEF SUMMARY OF THE INVENTION

The present invention includes a standup paddle with a variety of attachments thereto, a first set of attachments to assist in removing refuse from the water such as a net or sweeper to pick up trash in the water or nearby while stand up paddle boarding. The first set of attachments are proximal the paddle blade which is used for propulsion of the paddle board. The SUP sweeper allows a person to pick up trash from or in the water while on the board without having to bend their torso, allowing the user to keep from capsizing. When a person is paddle boarding and they see trash, using the present invention allows the person to pick up the trash easily without bending. The standup paddle of the present invention incorporates a net attached to the back of the paddle blade. The net preferably is no larger than the blade. The net is attached to the paddle shaft just above the blade. The net can be locked to the blade along the length of the shaft at different angles to the blade. In addition, a hook can be attached to the net or shaft for additional flexibility in picking up objects and removing them from the water. A first container, such as a laundry style basket or the like can be attached to the top side of the paddle board with suction cups or other attachment means. This basket or container is designed to receive refuse therein, after the refuse has been netted or hooked by the user of the stand up board paddle.

An alternate embodiment permits the handle of the stand up board paddle to be removed and be replaced by a game net. The game net functions in such a fashion to permit two or more people using stand up boards with the instant novel paddles of the invention to conduct any of a variety of ball oriented toss games while stand up boarding. In one version of the game the objective of the game is to pass, toss or shoot the ball with another person also on a paddle board, using the paddle stick to catch, carry, and pass the ball.

Particular rules of play may be implemented using ancillary devices such as floating goal posts, floating boundaries which have a plurality of floating elements connected by rope or the like. Teams may be chosen and scoring points may be a particular aim for such a sporting event. Since stand up boarding is generally performed on an open body of water it has been contemplated that such a game would be played on a lake, ocean or other natural body of water of sufficient size. Swimming pools, especially the larger ones, would certainly have sufficient room to play one of the many variants of the game.

It has been considered that the game version of the stand up board may include a second container placed atop the board to retain a game ball or the like therein. This second container could also be placed atop the board by suction cups or other attachment means. The second container may posses an inclined surface located inside the second container. The inclined surface would incline away from the user so that the ball while residing within the interior of the second container will roll forward within the container permitting it to be easily scooped out by the game net on the stand up board paddle.

It has also been considered that a single container may be employed which could perform both functions, the storage of refuse until it can be properly disposed of, as well as to store a game ball therein.

Stand up water boards with paddles including the accoutrements discussed herein, along with other devices which may be adapted to such a paddle would permit a great deal of water game variants to be played. It has further been contemplated that such paddles may be employed on a beach without the stand up board in order to play sporting events on the beach as well as allow the beach to be cleaned by employing the hook or trash net to grab and dispose of refuse.

DETAILED DESCRIPTION OF THE PREFERRED EMBODIMENT

Figure 1:
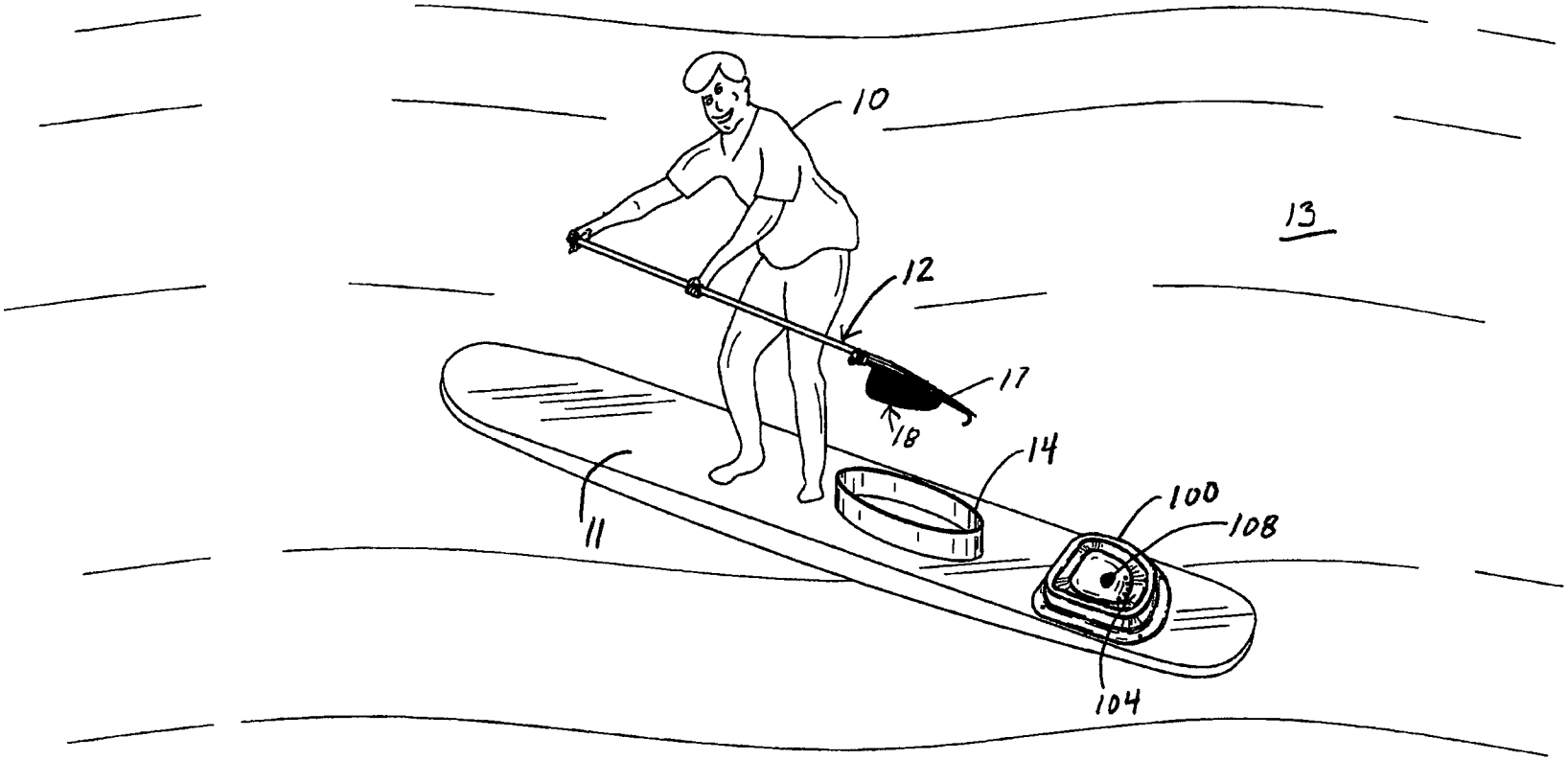
FIG. 1 shows a perspective view of a person on a stand up paddle board holding a first embodiment of the stand up paddle of the present invention.

Referring to FIG. 1, a person 10 or surfer is standing on a stand up paddle board 11, holding a stand up paddle 12. The board 11 is in the water 13, generally floating or gliding on the water surface 13. On paddle board 11 is a first container 14 attached to the board 11.

First container 14 can be of any construction to hold trash or other items and is removably attached to the topside of board 11 with suction cups (not shown) or any other attachment means.

The stand up paddle 12 includes a blade 17, a net 18, a hook 110 and means to attach them to shaft 16 (which will be discussed in FIGS. 4-6). The user 10 of the board 11 may capture debris, trash or the like with the net 18 or hook 110 an deposit it into the first container 14 to be disposed of properly. This has an advantage of cleaning eyesore trash from waterways and the like which has a positive environmental impact.

Figure 7:
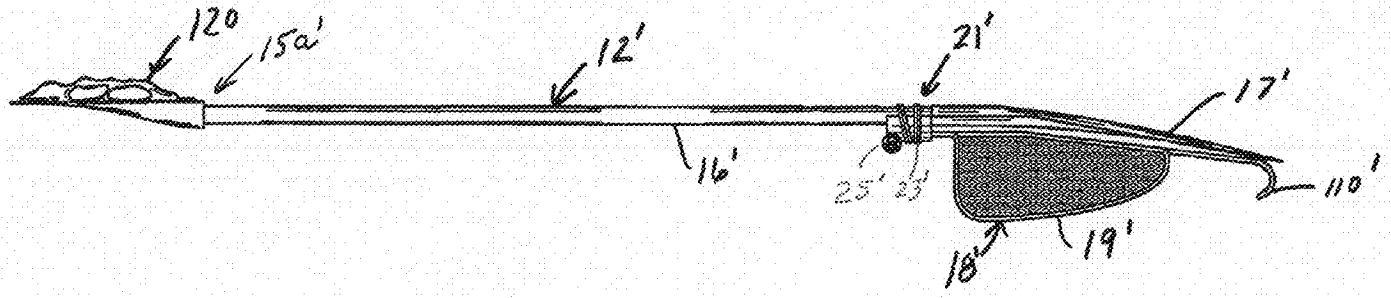
FIG. 7 shows a first side view of the second embodiment of the present invention including a ball catching device located on the opposite end of the paddle and the other devices associated therewith.
Figure 8:
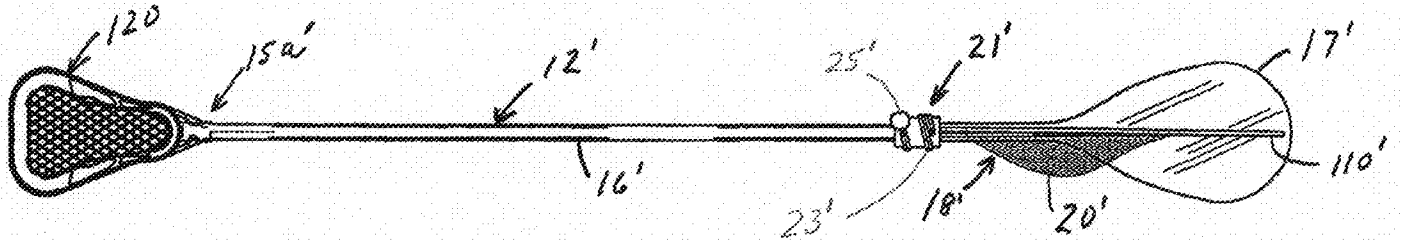
FIG. 8 shows a second side view of the second embodiment of the present invention including a view of the pouch of the ball catching device located in the opposite end of the paddle and the other devices associated therewith.
Figure 10:
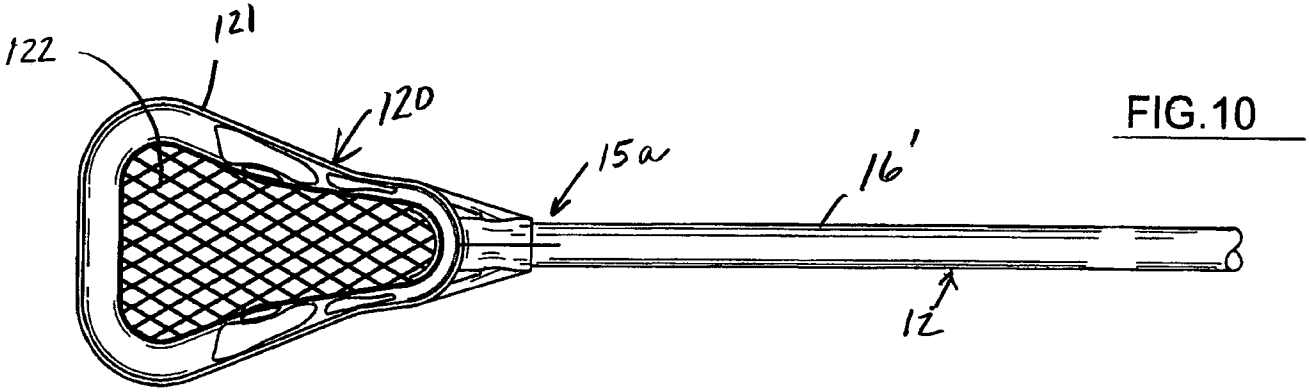
FIG. 10 shows a partial side view from another orientation of the second embodiment of the ball catching device of the present invention.
Figure 9:
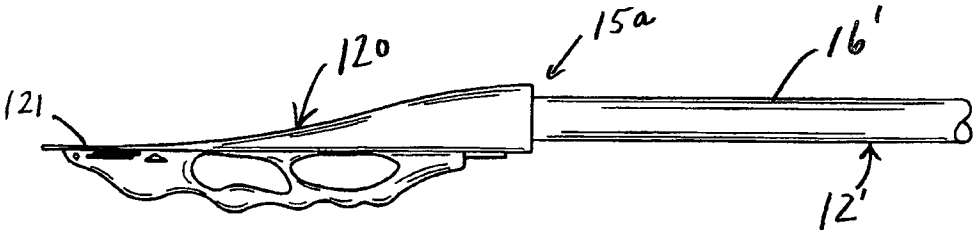
FIG. 9 shows a partial side view of the second embodiment of the ball catching device of the present invention.

A second container 100 is provided in front of the first container 14. The second container 100 will be discussed more thoroughly in FIGS. 12-16. The second container 100 is designed to hold a ball(s) which would be employed in a water sports game utilizing the stand up paddle 12 with a game net 120 disposed on the stand up paddle 12, the game net 120 is best seen in FIGS. 7 and 8. The second container 100 has a specific construction which permits it to be employed in the game play and may be attached to the topside of the board 11 with suction cups (not shown) or any other attachment means.

Figure 2:
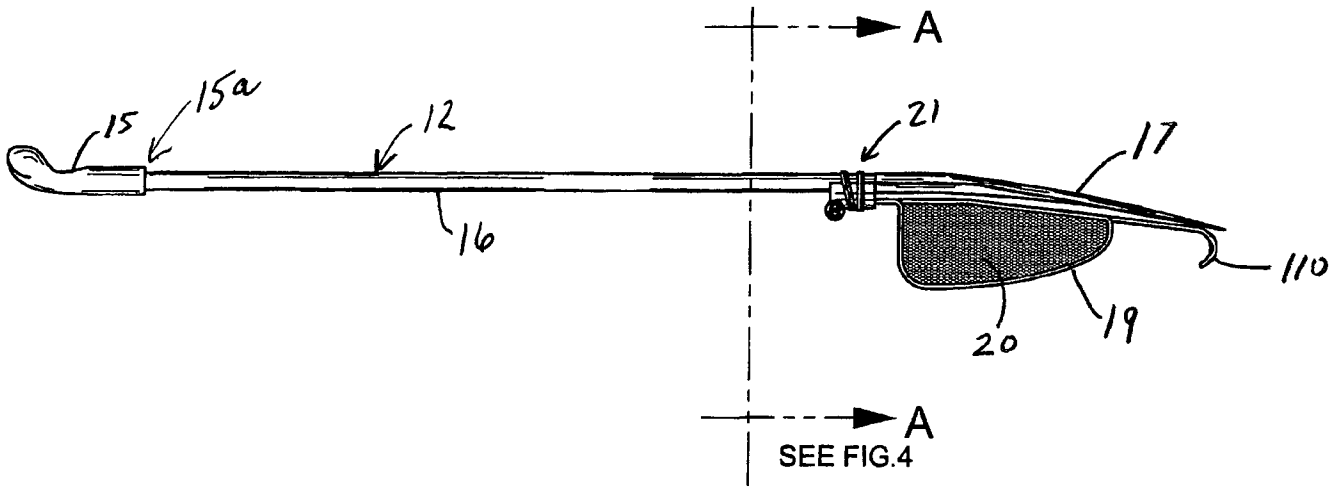
FIG. 2 shows a first side view of the first embodiment of the stand up paddle with a net and a hook of the present invention.
Figure 3:
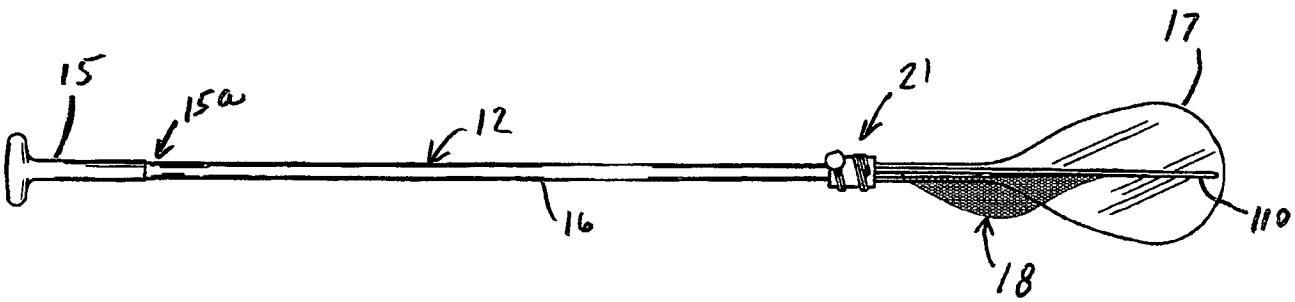
FIG. 3 shows a second side view of the first embodiment of the stand up paddle oriented to show the net, the hook and a face of the paddle of the present invention.

Referring now specifically to FIGS. 2 and 3 the stand up paddle 12 is shown in it's cleaning and it's propulsion configuration for use with the stand up paddle board 11 (shown in FIG. 1). The stand up paddle is shown in two side positions rotationally offset from each other in FIG. 2 and FIG. 3 respectively in order to help visualize the components thereon.

Figure 11:
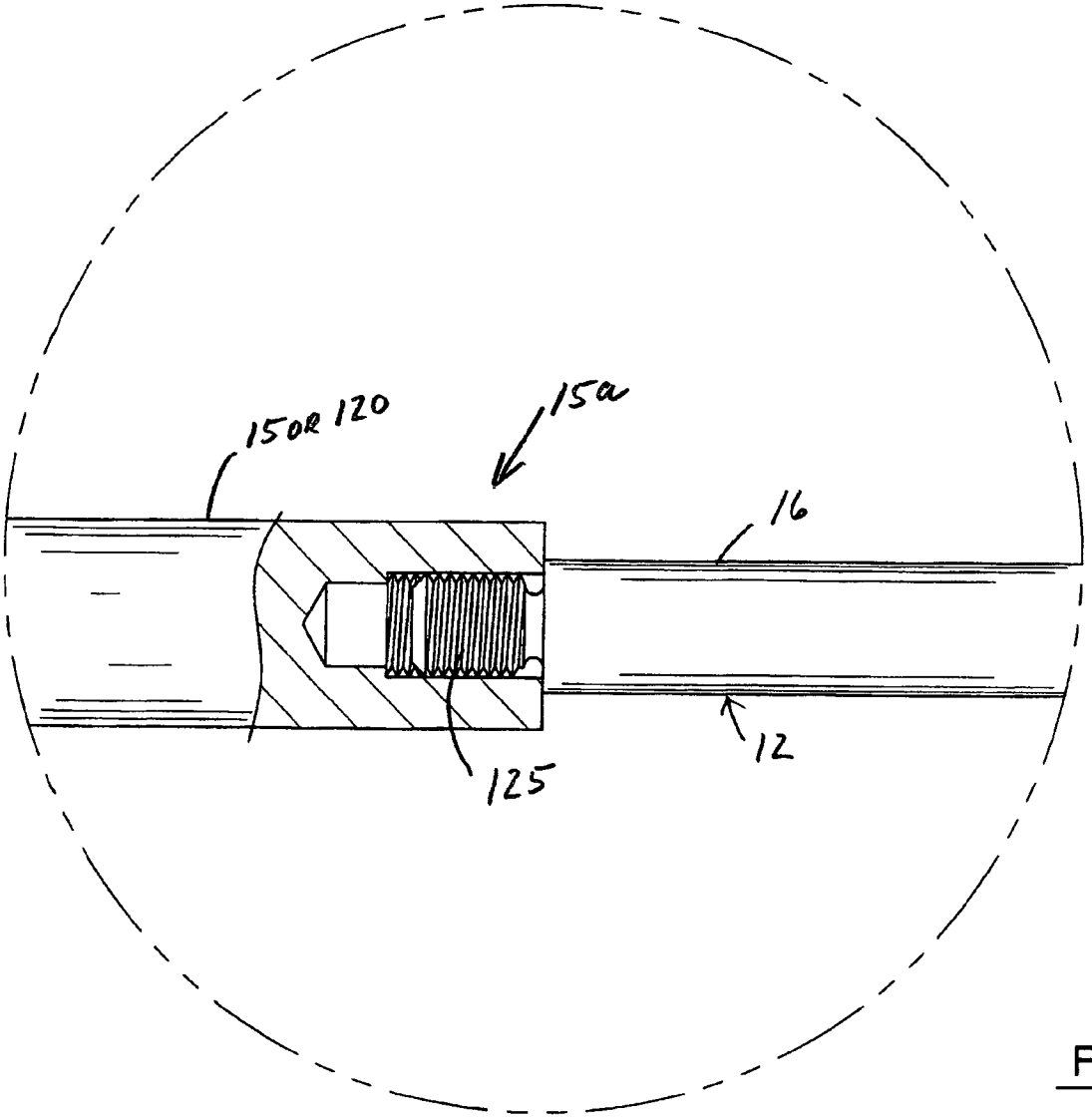
FIG. 11 shows a close up view coupled with partial cutaway view, showing a mechanical fastener which by rotation would permit one to remove the handle of the stand up paddle and permit it to be replaced by the game net, and conversely to permit the game net to be removed and be replaced by the handle of the stand up paddle.
Figure 12:
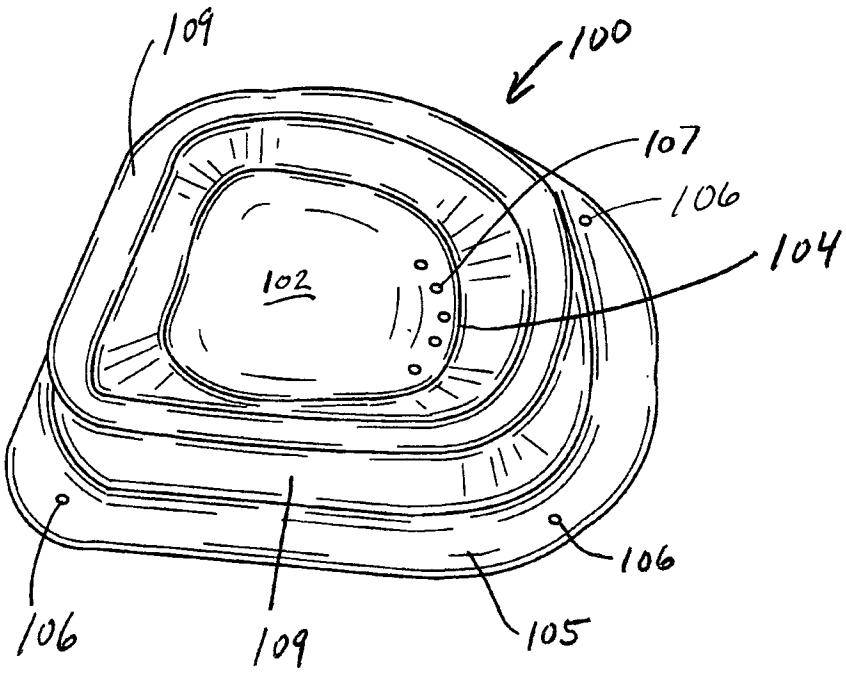
FIG. 12 is a perspective view of the second container which would be mounted on the stand up board and would carry the ball used in the water game.
Figure 13:
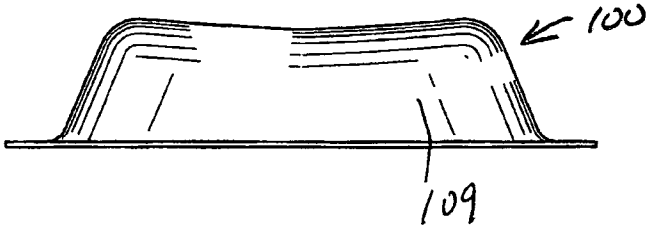
FIG. 13 is a front view of the second container which would be mounted on the stand up board and would carry the ball used in the water game.
Figure 14:
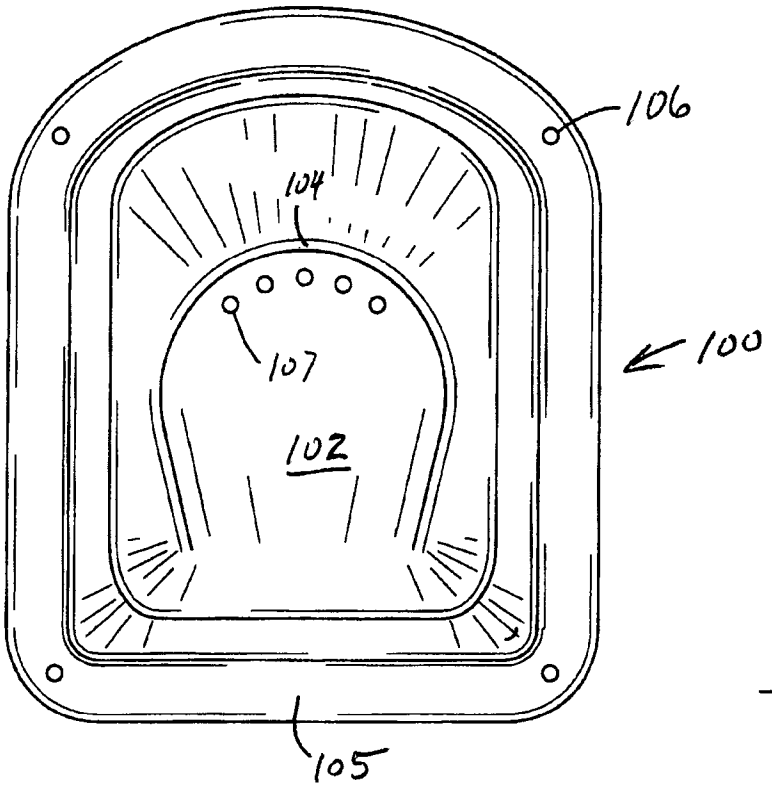
FIG. 14 is a top view of the second container which would be mounted on the stand up board and would carry the ball used in the water game.
Figure 16:
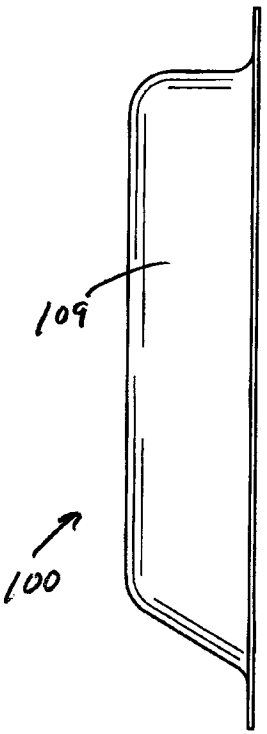
FIG. 16 is a side view of the second container which would be mounted on the stand up board and would carry the ball used in the water game.
Figure 15:
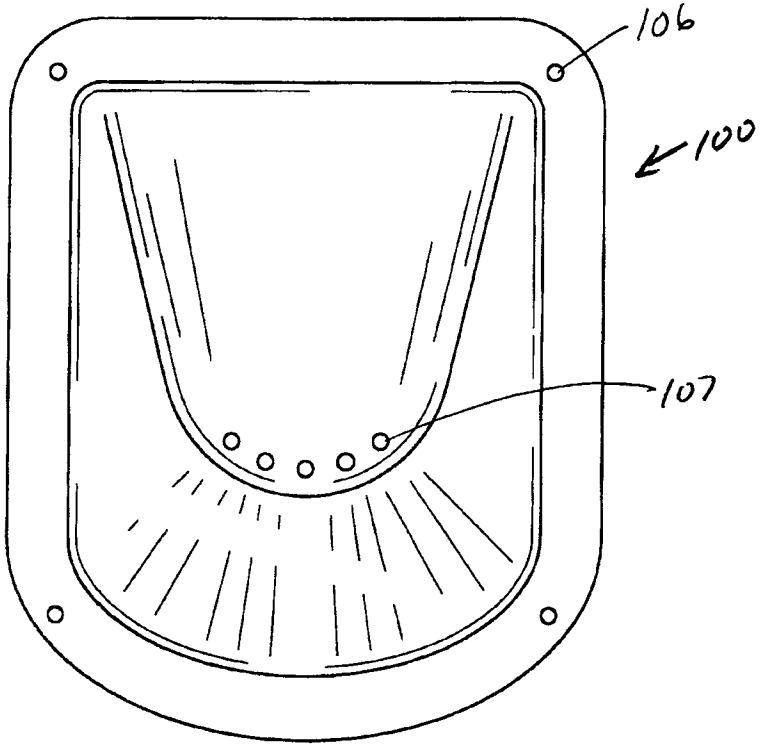
FIG. 15 is a bottom view of the second container which would be mounted on the stand up board.

Stand up paddle 12 includes a handle section 15, a shaft portion 16 and a blade 17. Handle section 15 is removable from the shaft portion 16 at approximately position 15A. By removing handle section 15, the game net 120 may be then inserted, converting the paddle 12 from it's cleaning and propulsion configuration into it's game play configuration. FIG. 11 shows a structural device which would permit the easy exchange of the handle section 15 with the game net 120.

Removably attached to the shaft 16 where it joins blade 17 is a net 18. The net 18 includes a net rim 19 which defines the net's 18 perimeter. The net 18 includes a web 20, which is comprised of matrix of interlocking fabric, which would permit the user to pick up refuse while stand up paddle searching. Web 20 may be made of any suitable material such as nylon or cotton. As can be seen in FIG. 4, net 20 is large enough to have a portion suspended below net rim 19.

Figure 4:
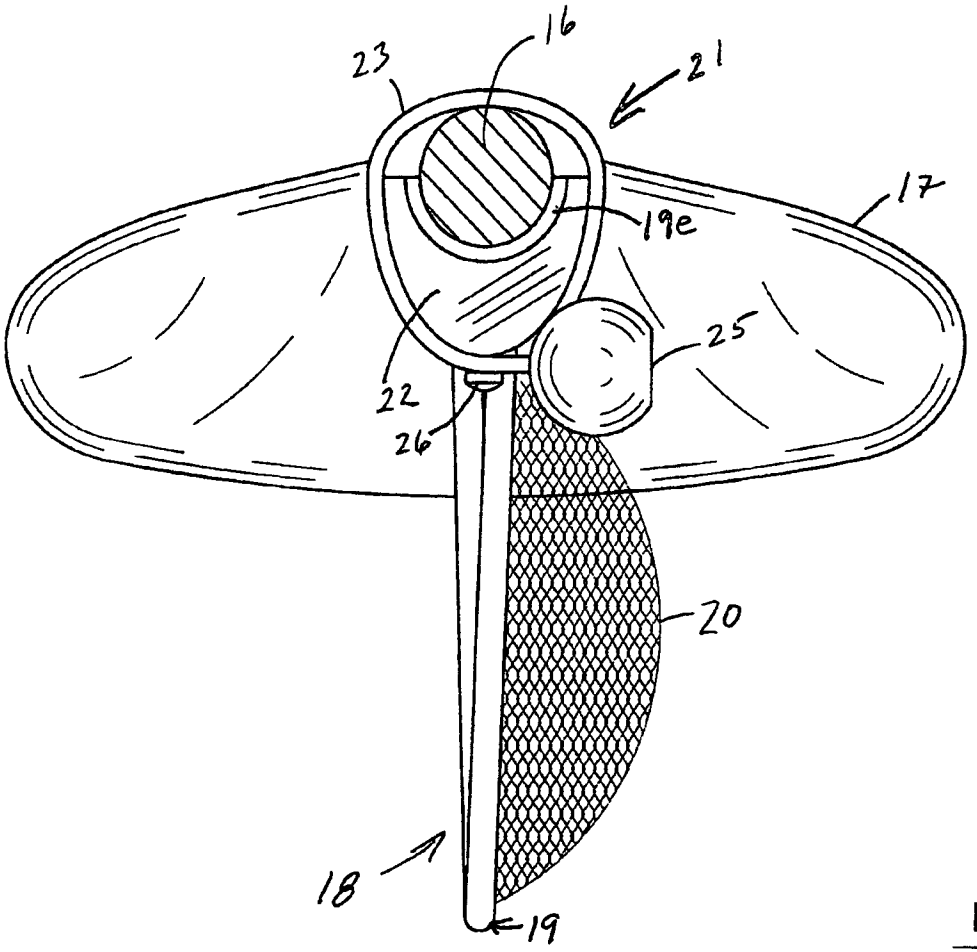
FIG. 4 shows a sectional view along lines A-A taken from FIG. 2.

Referring now to FIG. 4, a view taken along line A-A of FIG. 2 is shown. Rim 19 is attached to shaft 16 and held in position by a joint 21 which is attached to shaft 16. Rim 19 is rigidly attached to an elongated cup 22 at joint 21, which sandwiches rim 19 between cup 22 and shaft 16 which is held in place by an elastic cord 23. One end of cord 23 is attached to cup 22 at opening 24 (best seen in FIG. 6). The other end of cord 23 is attached to a small handle or ball 25 which is used to wrap cord 23 around cup 22 and shaft 16 and then ball 25 is secured to a pin 26 and held in place on cup 22.

Figure 5:
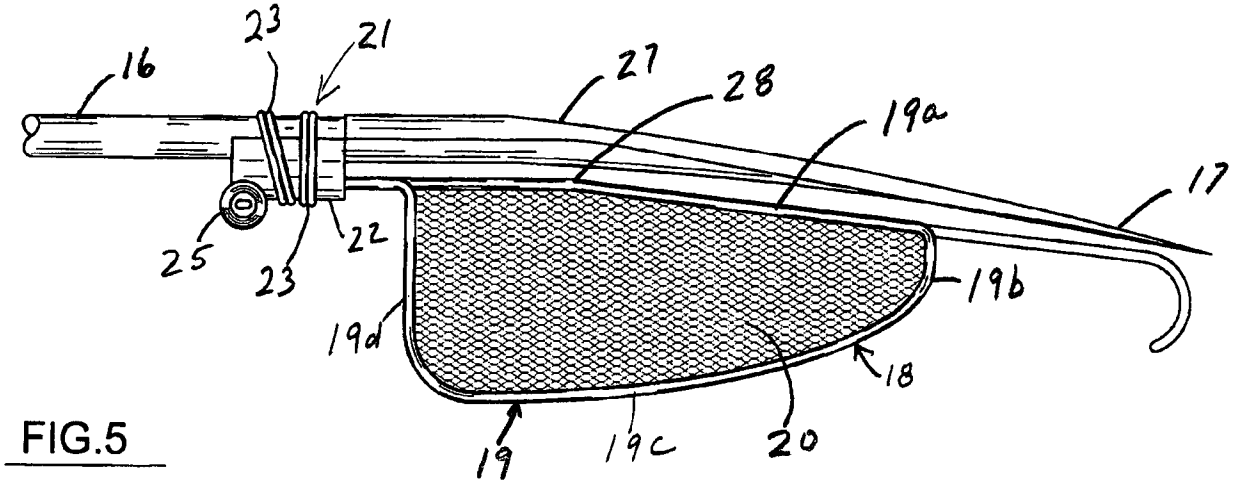
FIG. 5 shows a partial first side view of the first embodiment of the stand up paddle with a net, hook, and paddle of the present invention.
Figure 6:
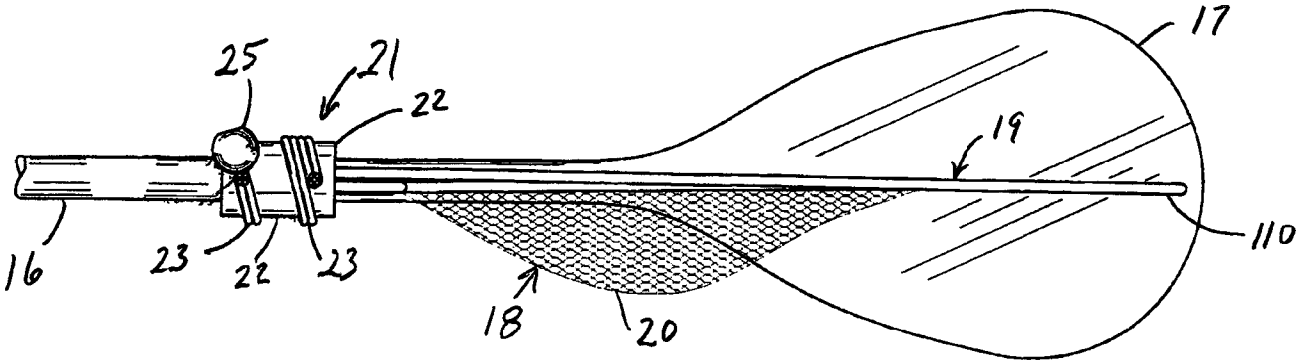
FIG. 6 shows a partial second side view of the first embodiment of the stand up paddle with a different angular orientation to show the net, hook and a face of the paddle of the present invention.

Referring now to FIGS. 5 and 6, net rim 19 is loop shaped and conforms on a first side 19*a* to blade 17, thus where the profile of blade 17 has a bend 27, first side 19*a* has a corresponding bend 28. The loop shape of rim 19 includes top portion 19*b*, second side 19*c* and bottom portion 19*d*. Side 19*a* and bottom 19*d* meet and form an elongated neck 19*e*. The bottom portion of neck 19*e* is the portion that is gripped between cup 22 and shaft 16. The hook 110 can be rigidly attached to shaft 16 at joint 21 or be attached to neck 19*e*. Alternatively, the hook 110 can be attached to rim 19 by welding or other fastening techniques. It has been considered that the hook 110 may be an optional component on some embodiments of the invention. The hook 110 is essentially an extension of rim 19 extending parallel to the blade 17. The hook 110 can be easily seen extending from the top portion of the rim 19*b* in FIG. 5. Whether the hook 110 is optional, welded or fastened on near the top portion of the rim 19*b* or an integral part of the rim 19 which is attached at joint 21 about the elongated neck 19*e* may be determined by the primary use of the invention. If the user has a greater affinity for group water sports, the hook 110 may be a superfluous element. However, it the user wishes to organize water clean up efforts and the like, the hook 110 with the paddle provides a vital role. In use, a surfer 10 may be surfing in water 13 and see a piece of garbage or other object to be retrieved. Using the present invention, the paddle 12 can be used to retrieve the object and place it into container 14. This would typically be performed by the surfer 10 scooping up the object into the net 18 by getting the object into the web 20 or by hooking the object with hook 110. Once the object is secured by the net 18 it is lifted out of the water and placed into the container 14.

An alternate embodiment of the stand up paddle 12' is shown in FIGS. 7 to 10. In FIGS. 7 and 8, the stand up paddle 12', shaft 16', the securing ball 25' which is affixed to elastic cord 23', net 18', web 20', rim 19' hook 110' and paddle blade 17' are identical to those shown in earlier Figures. In this embodiment the handle section 15 is removed from the shaft 16'. Shaft 16' has been tapped and the handle section 15 is threaded at an appropriate tolerance to allow it to be removed by simple rotation. Once the handle section 15 has been removed, the game net 120, which is also threaded to the correct tolerance, is rotated snugly on the end of the shaft 16' where the handle section 15 previously was. Once handle section 15 has been replaced by game net 120, the stand up paddle 12' will be in the play and propulsion configuration. Game net 120 has a frame 121 to support a net 122 to catch a game ball 108 that would have a diameter less than the width of frame 120. When the stand up paddle 12' is in the play and propulsion configuration, both the trash container 14 and the ball carrying container (second container) 100 (as shown in FIG. 1) may be present. However, it has been considered that the trash container 14 may be removed while in the play configuration to allow the player 10 to have move maneuverability on the top of the stand up paddle board 11 shown in FIG. 1, allowing greater freedom to make and catch ball tosses.

FIG. 11 shows a close up view coupled with partial cutaway view, showing a mechanical fastener which by rotation would permit one to remove the handle 15 of the stand up paddle and permit it to be replaced by the game net 120, and conversely to permit the game net 120 to be removed and be replaced by the handle 15 of the stand up paddle.

The shaft 16 of stand up paddle 12 has an end portion to which threading 125 has been applied. Additionally handle element 15 and game net 120 have both been tapped to permit the threading 125 to allow both the removal of handle element 15 when desired, as well as the insertion of the game net 120 and visa versa. This happens on the stand up paddle 12 at approximately point designated by 15A or 15A'.

Referring now to FIGS. 12-16, various orientations of the second container 100 are shown. The second container 100 is designed to retain a ball or balls for the game aspect of the invention. This is when the handle 15 of the stand up paddle 12 has been replaced by the game net 120 to permit a ball to be tossed back at for the between users as well as other game modalities.

In FIGS. 12-16, the second container 100 is shown from a variety of perspectives which normally would be attached to board 11 as shown in FIG. 1. It has an angled interior surface, that is, it slopes downward from element 102 to 104, where 104 is toward the front end of the board 11. This has the effect of having a ball 108 to seek the lower level near element 104.

This gives the user 10 the advantage of using the game net 120 to easily scoop the ball 108 from the second container 100. A plurality of apertures 107 are shown also on the lower level proximal element 104. Although 5 apertures 107 are shown in the Figures, the number of apertures 107 is in no way limiting. Depending on specific usage parameters the location and number of apertures 107 may be chosen to be anywhere within a range of 0 to 60. These apertures 107 permit water to flow out of the second container 100, also allowing easier access to the ball 108 therein. Sidewalls 109 surround the interior portion of the second container 100. Several apertures 106 are provided on the floor element 105 which is generally perpendicular to the sidewalls 109. The apertures 106 permit the second container 100 to be mounted to stand up paddle board 11 by mechanical fasteners. Other means to mount the second container to the stand up paddle board have been considered, including, but not limited to, suction cups, adhesives, heat welding, ultrasonic welding, other mechanical fasteners, duct tape and other fastening means.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

The invention claimed is:

1. A stand up paddleboard and paddle to be used by a surfer comprising, a top side, a first open top container attached to said top side toward the bow, and a second open top container attached to said top side in front of said first open top container, said paddle including a shaft having a first side and a second side, said shaft first side including a removable handle, and said shaft second side including a blade whereby said paddle is employed by the surfer for propelling said stand up paddleboard through a body of water, whereby said paddle includes a net affixed to a rim, said rim including a first elongated portion located on a first side of said net, said rim first elongated portion attached to said shaft second side by a first attachment means, wherein said first attachment means includes an elongated elastic cord affixed on a first side to said shaft second side, said elastic cord further affixed on a second side to a ball, said shaft second side includes a cup and a joint to receive said first elongated portion of said rim, said shaft further including a pin extending therefrom, whereby said elastic cord is wrapped about said shaft securing said first elongated portion of said rim thereto, and said elastic cord is further secured to said extending pin, permitting replacement or removal.

2. A stand up paddleboard as claimed in claim 1 wherein said paddle includes a second extensible portion on said rim, said second elongated portion oriented in a generally linear fashion to said shaft, and is further located on a second side of said net proximal to said blade.

3. A stand up paddleboard as claimed in claim 2 wherein said paddle said second elongated portion includes an end element wherein said end element includes a hook thereon, whereby the surfer may use said paddle employing said hook, said net, or the combination of said net and said hook, to capture trash and debris contaminating the water, and place the trash and debris in said first open top container for appropriate disposal.

4. A stand up paddleboard as claimed in claim 3 wherein said paddle includes an attachable game net.

5. A stand up paddleboard as claimed in claim 4 wherein said paddle said removable handle is removed and is replaced by said attachable game net.

6. A stand up paddleboard as claimed in claim 5 wherein said paddle employs said attachable game net to toss or throw a game ball whereby the ball may be tossed or thrown to any of a plurality of surfers riding said stand up paddleboard combined with said paddle.

7. A stand up paddleboard as claimed in claim 6 wherein said second open top container includes a first side closer to the surfer and a second side further from the surfer.

8. A stand up paddleboard as claimed in claim 7 wherein said second open top container said first side is higher than said second open top container said second side, whereby the game ball will roll to said open top container said second side whereby said surfer may easily scoop up the ball by said attachable game net for ease of play.

9. A stand up paddleboard as claimed in claim 8 wherein said second open top container includes a plurality of apertures through said second side, whereby any water which may accumulate inside second open top container would be removed.

10. A stand up paddleboard and paddle to be used by a surfer comprising, a top side, a first open top container attached to said top side toward the bow, said paddle to be employed by the surfer, said paddle including a shaft having a first side and a second side, said shaft first side including a removable handle, and said shaft second side including a blade whereby said paddle is employed by the surfer for propelling said stand up paddleboard through a body of water, said paddle further includes a net affixed to a rim, said rim including a first elongated portion located on a first side of said net, said rim first elongated portion attached to said shaft second side by a first attachment means, said paddle includes a second extensible portion on said rim, said second elongated portion oriented in a generally linear fashion to said shaft, and is further located on a second side of said net proximal to said blade, and said paddle said second elongated portion includes an end element wherein said end element includes a hook thereon, whereby the surfer may use said paddle employing said hook, said net, or the combination of said net and said hook, to capture, trash and debris contaminating the water, and place the trash and debris in said first open top container for appropriate disposal.

* * * * *